US007273651B1

(12) United States Patent
Wilde

(10) Patent No.: US 7,273,651 B1
(45) Date of Patent: Sep. 25, 2007

(54) CRACKLE FINISH

(76) Inventor: Rose Z. Wilde, 66 Timberland Ct., Foristell, MO (US) 63348

( * ) Notice: Subject to any disclaimer, the term of this patent is extended or adjusted under 35 U.S.C. 154(b) by 54 days.

(21) Appl. No.: 10/950,914

(22) Filed: Sep. 27, 2004

Related U.S. Application Data

(63) Continuation-in-part of application No. 09/924,991, filed on Aug. 8, 2001, now abandoned.

(60) Provisional application No. 60/225,597, filed on Aug. 15, 2000.

(51) Int. Cl.
*B44F 1/06* (2006.01)

(52) U.S. Cl. ..... 428/155; 428/195.1; 427/408; 427/325; 427/257; 524/220; 106/34

(58) Field of Classification Search ..... 427/408, 427/325, 257; 524/220; 106/34; 428/195.1, 428/155
See application file for complete search history.

(56) References Cited

U.S. PATENT DOCUMENTS

| | | | | | |
|---|---|---|---|---|---|
| 3,247,047 | A | * | 4/1966 | Buckley | 428/151 |
| 3,692,557 | A | * | 9/1972 | Sormani | 427/257 |
| 3,775,212 | A | * | 11/1973 | Iwasaki et al. | 156/220 |
| 3,839,073 | A | | 10/1974 | Hill | 427/402 |
| 3,904,791 | A | * | 9/1975 | Iverson et al. | 427/277 |
| 3,955,997 | A | | 5/1976 | Sagane et al. | 106/131 |
| 3,994,843 | A | | 11/1976 | Hickey | 524/35 |
| 4,017,493 | A | | 4/1977 | Ferment et al. | 427/257 |
| 4,046,934 | A | | 9/1977 | Gustafson | 428/155 |
| 4,313,976 | A | | 2/1982 | Leach | 427/297 |
| 4,317,847 | A | * | 3/1982 | Batistelli | 427/260 |
| 4,345,044 | A | * | 8/1982 | Columbus et al. | 523/220 |
| 4,386,180 | A | * | 5/1983 | Lat et al. | 524/272 |
| 4,409,276 | A | | 10/1983 | Martinelli et al. | 428/142 |
| 4,430,367 | A | | 2/1984 | Lat | 427/388.4 |
| 4,432,797 | A | * | 2/1984 | Vasishth et al. | 106/34 |
| 5,284,897 | A | | 2/1994 | Columbus et al. | 524/459 |
| 5,512,323 | A | * | 4/1996 | Beane et al. | 427/408 |
| 5,601,876 | A | * | 2/1997 | Oates et al. | 427/257 |
| 6,036,761 | A | | 3/2000 | Columbus et al. | 106/162.5 |
| 6,110,317 | A | | 8/2000 | Sandor | 156/235 |
| 6,217,336 | B1 | * | 4/2001 | Matthews | 434/84 |
| 6,547,872 | B1 | | 4/2003 | Fleming | 106/715 |

OTHER PUBLICATIONS

The Use of Hide Glue as an Adhesive, http://www.bjorn.net/purpose.htm, Aug. 7, 2001.
Re: Crackle finish using glue, http://wwvisions.com/craftbb/gencraft/2159.html, Aug. 14, 2000.

(Continued)

*Primary Examiner*—Rena Dye
*Assistant Examiner*—Tamra L. Dicus
(74) *Attorney, Agent, or Firm*—Grace J. Fishel

(57) ABSTRACT

A crackle finish, method of forming a crackle finish and a kit for forming a crackle finish. The crackle finish includes a base coat of latex paint or stain on a surface to be treated. A crackle coating is applied over the base coat and dried to tack dry or completely dried. A latex wood filler is applied over the crackle medium. As the latex wood filler dries, it forms islands or domains separated by cracks or valleys revealing glimpses of the underlaying base coat.

7 Claims, 2 Drawing Sheets

OTHER PUBLICATIONS

The Old Fashioned Milk Paint Co., Inc., Product Bulletin for Antique Crackle, http://www.milkpaint.com/crackpb.htm, Aug. 14, 2000.

The Old Fashioned Milk Paint Co., Inc., Material Safety Data Sheet for Antique Crackle, http://www.milkpaint.com/crackmsd.htm, Aug. 14, 2000.

* cited by examiner

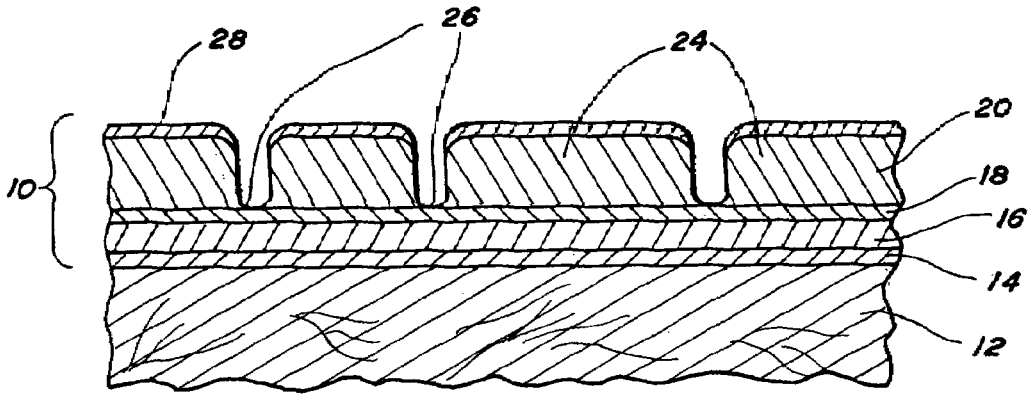
FIG. 1
FIG. 2
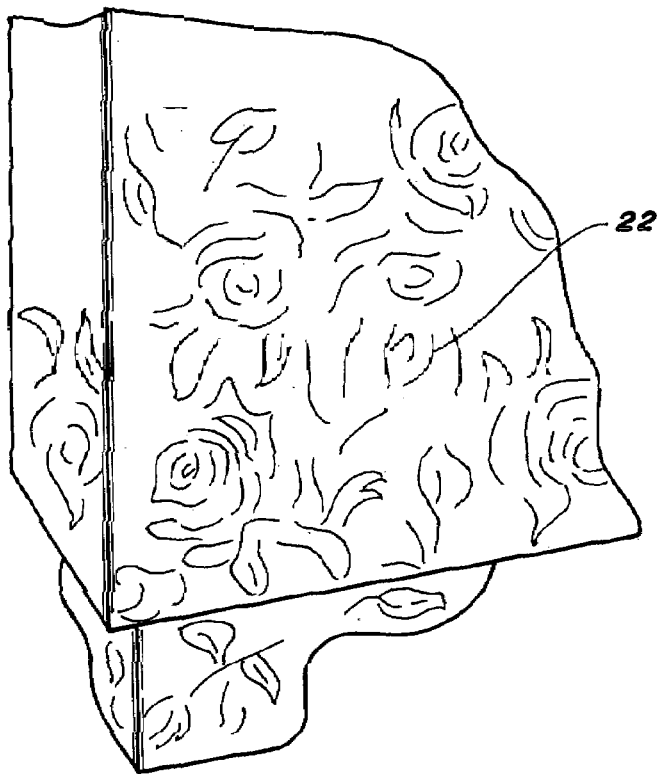

CRACKLE FINISH

This application claims the benefit of provisional patent application Ser. No. 60/225,597, filed Aug. 15, 2000 for Crackle Finish, and is a continuation-in-part of Ser. No. 09/924,991, filed Aug. 8, 2001 now abandoned, for Crackle Finish.

BACKGROUND OF THE INVENTION

1. Field of the Invention

The present invention relates to a crackle finish for making the surface of an object appear cracked.

2. Brief Description of the Prior Art

Crackle finishes for painted surfaces are created by applying a base coat of a latex paint to a prepared surface. The base coat is dried and a crackle medium applied and dried. A top coat of a different colored latex paint is then applied. As the top coat dries, the crackle medium causes the top coat to crack revealing glimpses of the base color through the cracks. It is an inherent property of a crackle medium to contract when a water-based stain or paint is applied to the dried crackle medium.

Ordinary crackle finishes make the paint look old. In some instances, however, it would be desirable to provide a crackle finish that makes the surface of the object, not just the paint, appear cracked. Such a finish can be used to provide a distressed, antique or aged look to furniture, woodwork or the like. Such finishes are sought to provide a casual country look or to simulate the refined elegance of old European furniture.

BRIEF SUMMARY OF THE INVENTION

In view of the above, it is an object of the present invention to provide a crackle finish for a surface such that the surface appears cracked. It is a further object to provide a method of applying a crackle finish to a surface such that it appears cracked. It is another object to provide such crackle finish as a kit. Other objects and features of the invention will be in part apparent and in part pointed out hereinafter.

In accordance with the invention, a crackle finish for making a surface of an object appear cracked includes a base coat of a latex paint or stain disposed on the surface, a crackle medium disposed on the base coat and a latex wood filler coat disposed on the crackle medium. A method for forming the crackle finish comprises applying the above mentioned layers in the order mentioned. A kit for forming the crackle finish comprises a base coat of a latex paint or stain, a crackle medium and a latex wood filler. The kit may also contain a top coat to be applied over the latex wood filler.

The invention summarized above comprises the constructions and methods hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which:

FIG. 1 is a sectional view showing a crackle coat on a surface in accordance with the present invention;

FIG. 2 is a perspective view of a piece of furniture, partially broken away, showing a rose design embossed into a crackle coat in accordance with the present invention; and, FIG. 3 is an exploded perspective view showing the layers making up the crackle coat on a surface in accordance with the present invention.

DETAILED DESCRIPTION OF THE INVENTION

Figure 3:
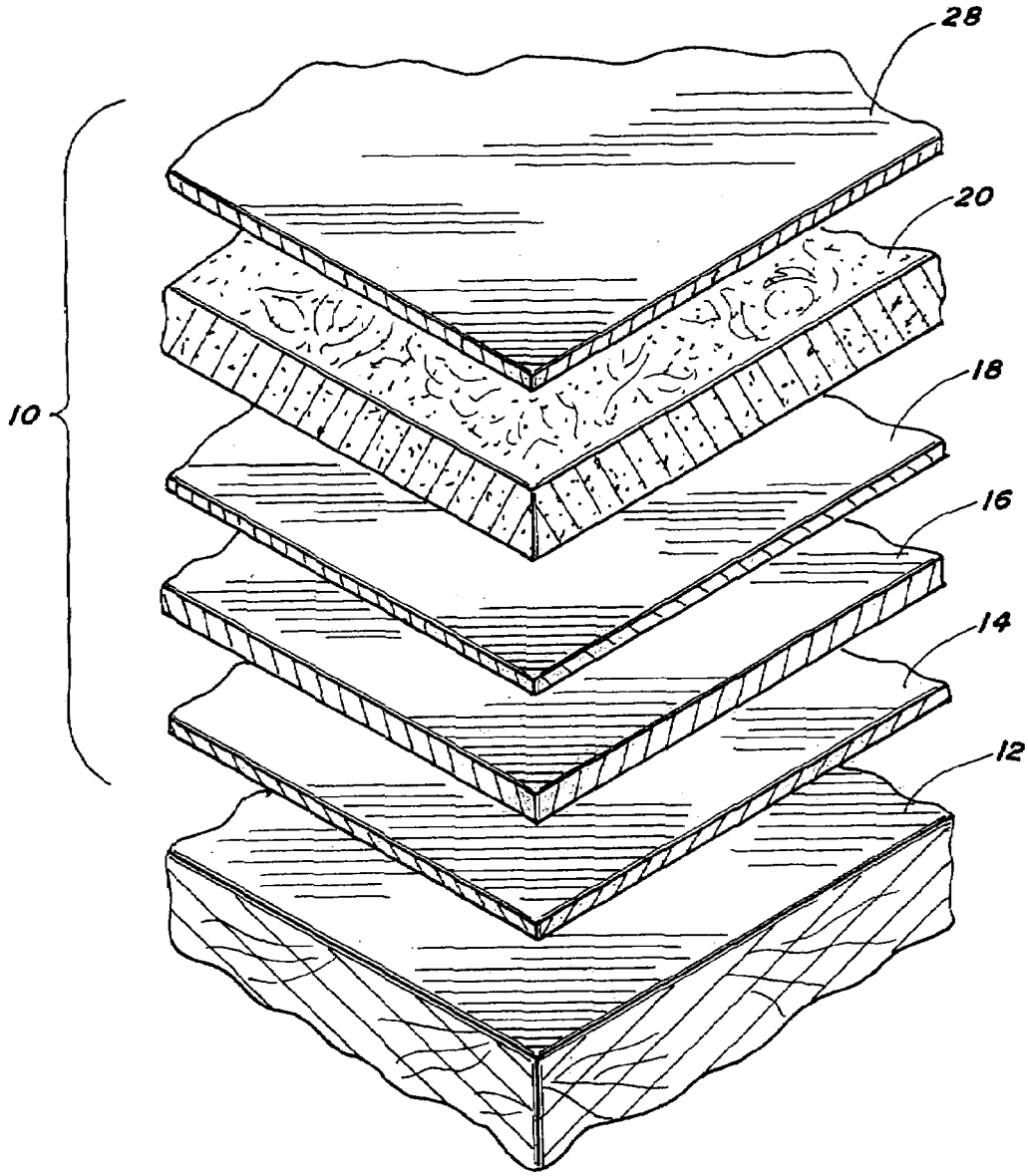

Referring to the drawings more particularly by reference character, the present invention consists of a multi-layered crackle finish 10 as shown in FIGS. 1 and 3 for an object made of wood, metal, plastic or the like such that the surface of the object appears cracked. While crackle finish 10 may be applied to any surface that is clean, dry and free of grease, oil or loose particles, it is preferably used on a wood surface 12. Wood surface 12 may be prepared by sanding or other treatment to provide a smooth surface.

If it is desired to seal wood surface 12, a sealer coat 14 may be applied. Sealer coat 14 keeps subsequent coatings from entering or bleeding into wood surface 12. Sealer coat 14 may be applied directly to wood surface 12. Sealer coat 14 is preferably an aqueous based polymer formulation, but an oil based coating may be used. Sealer coat 14 is dried.

The next coating is a base coat 16 of a latex paint or stain. Latex formulations use water as a solvent for binding the particles of pigment with a latex such as acrylic or vinyl. Latex paint is available in several degrees of gloss. Base coat 16 for use in developing crackle finish 10 is preferably a flat or semigloss latex paint. Base coat 16 is applied to sealer coat 14 or directly to surface 12 and dried.

A layer of crackle medium 18 is applied to base coat 16. Crackle medium 18 causes a subsequently applied water-based latex wood filler coat 20 to crack as it dries. At the present time, the preferred crackle medium 18 is RALPH LAUREN Historic Crackle Medium. Other crackle media may also be used, with more or less success, such as LAURA ASHLEY Crackle Medium, Weathered Crackle Glaze #97097, sold by Valspar Corporation, Plaid Enterprise Crackle Medium, Delta Crackle Medium and Elmer's glue sold by Elmer's Products, Inc. Of those mentioned above, Elmer's glue provides the least desirable results. ANTIQUE CRACKLE, sold by The Old Fashioned Milk Paint Co., Inc. and hide glue are used as crackle media with latex paints and may be useful for the present purpose also. Depending on the nature of crackle medium 18, it is applied over base coat 16 and dried to the tack stage or dried completely. Some products, such as RALPH LAUREN Historic Crackle Medium advise that the crackle medium should not be allowed to dry more than four hours before applying a topcoat of latex paint. But with water-based latex wood filler coat 20, it not critical when wood filler coat 20 is applied to crackle medium 18 other than the crackle medium must dry to touch. Crackle medium 18 may be allowed to dry more than four hours or even for several days before wood filler coat 20 is applied.

Disposed on layer of crackle medium 18 is a coating of latex wood filler 20. The thickness of latex wood filler 20 depends upon the size of the cracks desired on surface 12. The preferred latex wood filler for wood filler coat 20 is Elmer's Carpenter Interior Wood Filler (Product #E-833). Other suitable latex wood fillers include Pro Finisher Full-Trowel Wood Filler by Parks. On the other hand, some latex wood fillers such as Synko Wood Filler is compatible with only a few crackle mediums and even then it does not crack reliably. While others such as Durham's Rock Hard Wood Putty, if mixed according to the manufacturer's directions, does not form a good wood filler coat 20 but when it is mixed with a latex flat paint, it does produce cracks.

The above-mentioned latex wood fillers for wood filler coat 20 include an acrylic binding resin, talc, fillers and water. Common fillers are various silicates, carbonates and sulfates such as clay, limestone, calcium carbonate, magnesium carbonate, barytes, etc. Water is added to produce a filler that spreads easily when applied and drys into a hard mass. Hard and soft acrylic monomers as described in U.S. Pat. No. 4,345,044 or the like may be blended to yield a latex wood filler with desired properties. The fillers and proportions also affect the product.

Elmer's Interior Carpenter's Wood Filler is preferred for wood filler coat 20. According to a Material Safety Data Sheet published by Elmer's Products, Inc. this material includes an acrylic binding resin and 5 to 10% by weight magnesium carbonate, 50 to 70% limestone, 1 to 5% chlorite (mineral class), 1 to 5% kaolin, 1 to 5% calcite, 5 to 10% talc and 0.1 to 0.99% quartz. The product is a yellow paste and has a specific gravity of 1.71. On the other hand, Elmer's Carpenter's Exterior Wood Filler does not crack properly over crackle medium 18 and is therefore not suitable for creating crackle finish 10. This filler has an acrylic binding resin and 5 to 10% by weight magnesium carbonate, 30 to 50% limestone, 1 to 5% chlorite (mineral class), 1 to 5% kaolin, 1 to 5% calcite, 5 to 10% talc and 0.1 to 0.99% quartz. It is a tan paste having a specific gravity of 1.21.

After latex wood filler coat 20 has been applied over crackle medium 18, if desired the wood filler coat may be embossed with designs 22 as shown in FIG. 2 or otherwise worked. Latex wood filler coat 20 is dried, forming raised islands or domains 24 separated by cracks or valleys 26, making surface 12 appear cracked and revealing glimpses of underlying base coat 16.

A desired top coat 28 may be applied to latex wood filler coat 20, either as a stain or paint. Top coat 28 may be oil based to protect crackled finish 10, if the object is a frequently used piece of furniture. On other objects or if preferred, top coat 28 may be an aqueous based paint or stain. Top coat 28 may also be incorporated into wood filler coat 20. Top coat 28 is preferably a flat or semi-gloss latex paint and is preferably lighter in color than base coat 16 which is seen in the cracks or valleys. Top coat 28 is dried.

Application of the above-mentioned coats can be done by, but is not limited to, brushing, rolling, spraying or troweling, using conventional spraying or spreading equipment.

As described above, the antique look of crackle finish 10 is obtained through a multi-step process, beginning with an initial preparing of surface 12 such as by sanding. This is followed by, up to but not limited to, three coatings. The coatings consist of an initial base coat 16 followed by a crackle medium 18 and a wood filler coat 20. Base coat 16 and wood filler coat 20 are aqueous based. Top coat 28 may then be applied as a fourth coat. Additional steps may be added, such as applying sealer coat 14 to surface 12 or a glaze coat (not shown) over the base coat 16 or top coat 28, and so forth. A crackle finish kit includes (1) a base coat 16, (2) a crackle medium 18 and (3) a wood filler coat of latex wood filler 20, preferably together with (4) a top coat 28.

In view of the above, it will be seen that the several objects of the invention are achieved and other advantageous results attained. As various changes could be made in the above constructions and methods without departing from the scope of the invention, it is intended that all matter contained in the above description or shown in the accompanying drawings shall be interpreted as illustrative and not in a limiting sense.

What is claimed is:

1. A crackle finish prepared by a process comprising the sequential steps of:

(a) applying a base coat of a latex paint or stain to a surface;

(b) drying the base coat of the latex paint;

(c) applying a crackle medium that contracts and crackles when a water-based stain or paint is applied to the dried crackle medium;

(d) drying the crackle medium at least to tack dry;

(e) applying a latex wood filler coat to the dried crackle medium;

(f) drying the latex wood filler coat whereby the crackle medium reacts with the latex wood filler to form raised islands or domains of the crackle medium and the latex wood filler coat separated by cracks or valleys revealing glimpses of the underlaying base coat.

2. The crackle finish of claim 1 wherein the crackle medium in step (d) is tack dried before the latex wood filler is applied.

3. The crackle finish of claim 2 wherein after step (e) and before step (f) the latex wood filler is embossed with a design.

4. The crackle finish of claim 1 wherein the latex wood filler applied in step (e) comprises an acrylic binding resin, talc, fillers and water.

5. A method of forming a crackle finish on a surface comprising the sequential steps of:

(a) applying a base coat of a latex paint or stain to a surface;

(b) drying the base coat of the latex paint;

(c) applying a crackle medium that contracts and crackles when a water-based stain or paint is applied to the dried crackle medium;

(d) drying the crackle medium at least to tack dry;

(e) applying a latex wood filler coat to the dried crackle medium;

(f) drying the latex wood filler coat whereby the crackle medium reacts with the latex wood filler to form raised islands or domains of the crackle medium and the latex wood filler coat separated by cracks or valleys revealing glimpses of the underlaying base coat.

6. The method of claim 5 wherein the latex wood filler coat in step (e) is embossed with a design before it is dried in step (f).

7. The method of claim 5 wherein the surface in step (a) is wood and a sealer coat is applied to the surface before the base coat is applied in step (a).

* * * * *